US009698576B2

(12) United States Patent
Niessner et al.

(10) Patent No.: US 9,698,576 B2
(45) Date of Patent: Jul. 4, 2017

(54) METHOD FOR MANUFACTURING AN IGNITION ELECTRODE FOR SPARK PLUGS AND SPARK PLUG MANUFACTURED THEREWITH

(71) Applicant: Federal-Mogul Ignition GmbH, Neuhaus-Schierschnitz (DE)

(72) Inventors: Werner Niessner, Steinheim (DE); Matthias Blankmeister, Haan (DE)

(73) Assignee: FEDERAL-MOGUL IGNITION GMBH, Neuhaus-Schierschnitz (DE)

( * ) Notice: Subject to any disclaimer, the term of this patent is extended or adjusted under 35 U.S.C. 154(b) by 0 days.

(21) Appl. No.: 15/265,602

(22) Filed: Sep. 14, 2016

(65) Prior Publication Data

US 2017/0085061 A1 Mar. 23, 2017

(30) Foreign Application Priority Data

Sep. 17, 2015 (DE) ..... 10 2015 115 746

(51) Int. Cl.
*H01T 13/20* (2006.01)
*H01T 13/39* (2006.01)
*H01T 21/02* (2006.01)

(52) U.S. Cl.
CPC ..... *H01T 21/02* (2013.01); *H01T 13/39* (2013.01)

(58) Field of Classification Search
CPC ..... H01T 21/02; H01T 13/39; H01T 13/38; H01T 13/20; H01T 13/34; H01T 13/36; H01T 13/467; H01T 13/52
See application file for complete search history.

(56) References Cited

U.S. PATENT DOCUMENTS

| | | | |
|---|---|---|---|
| 3,350,759 | A | 11/1967 | Antunes |
| 5,477,022 | A | 12/1995 | Friese |
| 5,551,902 | A | 9/1996 | Hubert |
| 6,080,029 | A | 6/2000 | Johnson |
| 6,628,051 | B1 | 9/2003 | Menken |
| 7,279,827 | B2 | 10/2007 | Nunome |
| 8,079,136 | B2 | 12/2011 | Walker, Jr. |
| 8,575,830 | B2 | 11/2013 | Ma |

(Continued)

FOREIGN PATENT DOCUMENTS

| | | | |
|---|---|---|---|
| DE | 3612135 | A1 | 10/1987 |
| DE | 10348778 | B3 | 7/2005 |

(Continued)

OTHER PUBLICATIONS

German Office Action for Application No. 102015115746.2 Dated May 17, 2016, 6 pages.

*Primary Examiner* — Tracie Y Green
(74) *Attorney, Agent, or Firm* — Reising Ethington P.C

(57) ABSTRACT

A method for manufacturing an ignition electrode for spark plugs for internal combustion engines. The method includes producing by powder metallurgy a green part or brown part containing the base metal or the base metal alloy, coating of a part of the surface of the green part or brown part with a mixture that contains the precious metal or the precious metal alloy in the form of a powder and a binder, removing the binder from the layer that was formed by the coating and that contains the precious metal or the precious metal alloy, and sintering the coated green part or brown part to form a composite part. The composite part is welded as an end piece to the one end of the base-metal section of the ignition electrode.

21 Claims, 3 Drawing Sheets

(56) References Cited

U.S. PATENT DOCUMENTS

| | | | |
|---|---|---|---|
| 8,766,519 | B2 | 7/2014 | Ma |
| 9,077,158 | B2 | 7/2015 | Murayama |
| 2007/0236123 | A1 | 10/2007 | Lykowski |
| 2011/0198983 | A1 | 8/2011 | Manhardt |
| 2012/0125279 | A1 | 5/2012 | Hampson |
| 2014/0265812 | A1 | 9/2014 | Ma |

FOREIGN PATENT DOCUMENTS

| | | | |
|---|---|---|---|
| DE | 102013219520 | A1 | 4/2014 |
| DE | 102013226163 | A1 | 6/2015 |
| EP | 0250322 | | 1/1994 |
| EP | 0660485 | | 6/1995 |
| EP | 0561812 | | 11/1995 |
| EP | 0860043 | | 8/1998 |
| EP | 1576707 | B1 | 5/2010 |
| JP | 2003332020 | A | 11/2003 |
| JP | 2006228688 | A | 8/2006 |

METHOD FOR MANUFACTURING AN IGNITION ELECTRODE FOR SPARK PLUGS AND SPARK PLUG MANUFACTURED THEREWITH

This application claims the benefit of German Application No. 10 2015 115 746.2, filed on Sep. 17, 2015 the contents of which are hereby incorporated by reference in their entirety.

FIELD

The present invention generally relates to a method of manufacturing a spark plug electrode.

BACKGROUND

A method of manufacturing a spark plug electrode and a spark plug manufactured therewith are disclosed in EP 1,576,707 B1. In the prior art spark plug, the center electrode and the ground electrode are each provided with an end piece, called a firing tip in EP 1,576,707 B1, that is made of a precious metal alloy primarily containing iridium. These end pieces are bonded to the center electrode and the ground electrode by laser welding. The purpose of tipping the electrodes with end pieces made of an iridium alloy is to extend the service life of the spark plug, which iridium and iridium alloys are well suited for. However, iridium is a costly precious metal.

SUMMARY

An object of the present design is to reduce the cost of manufacturing spark plugs.

This object may be attained by a method with the features specified in claim 1. Advantageous further developments are the subject matter of the dependent claims.

According to the present disclosure, there is provided a method for manufacturing ignition electrodes for spark plugs that have a section made of a base metal or a base metal alloy that is tipped at one end with a precious metal or with a precious metal alloy, these being manufactured by the means that firstly a green part or brown part containing the base metal or the base metal alloy is produced by powder metallurgy. A green part is understood here to be a body that is produced from a powder or a powder mixture by powder metallurgy through pressing, and that can still contain a binder in addition to the metal powder. A brown part is understood here to be a body that is produced by powder metallurgy through pressing and that has been rid of a binder that was originally contained therein. A core is understood here to be the core or body of the composite part and may take the form of, and be referred to herein, as a green part, a base metal green part, a brown part, a core, a body, etc.; each of these terms refers to a core. Removal of the binder from the pressed body is also referred to as debinding. Neither the green part nor the brown part has been sintered yet.

According to one embodiment, a portion of the surface of the green part or brown part is coated with a mixture that contains the precious metal or the precious metal alloy in the form of a powder and a binder. Next, the binder is removed from the layer that contains the precious metal or the precious metal alloy (debound). Next the coated and debound green part or brown part is sintered. The result is a composite part that consists predominantly of the base metal or the base metal alloy, wherein a portion of the surface of the compound part has a layer that is firmly bonded by the sintering process and that contains the precious metal or the precious metal alloy. A side of the composite part thus formed that faces away from the precious metal or precious metal alloy is then welded to the one end of the base-metal section of the ignition electrode.

At least some embodiments have the advantage that the composite part that is welded as an end piece to one end of the base-metal section of the ignition electrode is not made of solid precious metal or precious metal alloy, but instead is made partly, preferably predominantly, of the base metal or base metal alloy. In this way, the quantity of the costly precious metal required when tipping the ignition electrodes with precious metal can be reduced without sacrifices in service life as compared to the prior art.

Another potential advantage is that, as a result of the use of the composite part as an end piece, welding of the end piece to the one end of the base-metal section of the ignition electrode is problem-free because the two surfaces to be welded to one another can be made predominantly of the same base metal or predominantly of the same base metal alloy. Problems that have occurred in the prior art due to the welding of an end piece made of a precious metal or of a precious metal alloy to the base-metal section of the ignition electrode, for example because of different coefficients of thermal expansion, are avoided or are less significant when the present method is used. This could be due to the fact that the present method may result in an interlocking between the layer containing the precious metal or precious metal alloy and the base metal or base metal alloy underneath it. As a result of the sintering process, intermetallic compounds can be formed in the bonding zone that further increase the bonding effect in combination with the interlocking of the layer containing the precious metal or precious metal alloy and the base metal or base metal alloy underneath it.

Suitable binders and methods for removing the binder from the green part (debinding) are known to the person skilled in the art from metal injection molding technology. For example, a thermoplastic plastic that can be removed by, e.g., burnout or pyrolysis, can be used as the binder.

The base-metal section of the ignition electrode and the composite part can be cylindrical. They are then especially suitable for manufacturing a center electrode of a spark plug.

The base metal or the base metal alloy can have a composition that is normally used for spark plugs. The use of nickel and nickel-based alloys, in particular Inconel 600, is known and suitable.

The precious metals or precious metal alloys used for tipping the ignition electrodes can likewise be the same ones that are already known for use in spark plugs, in particular iridium and alloys of iridium, in particular an alloy composed of platinum and iridium. The precious metal alloy may also contain relatively small quantities of one or more base metals, for example tungsten and/or zirconium, however.

Preferably, the composite part is manufactured through metal injection molding (MIM). This method is especially suitable for producing small bodies such as are required for tipping ignition electrodes.

DRAWINGS

Preferred exemplary embodiments will hereinafter be described in conjunction with the appended drawings, wherein like designations denote like elements, and wherein.

DESCRIPTION

Figure 1:
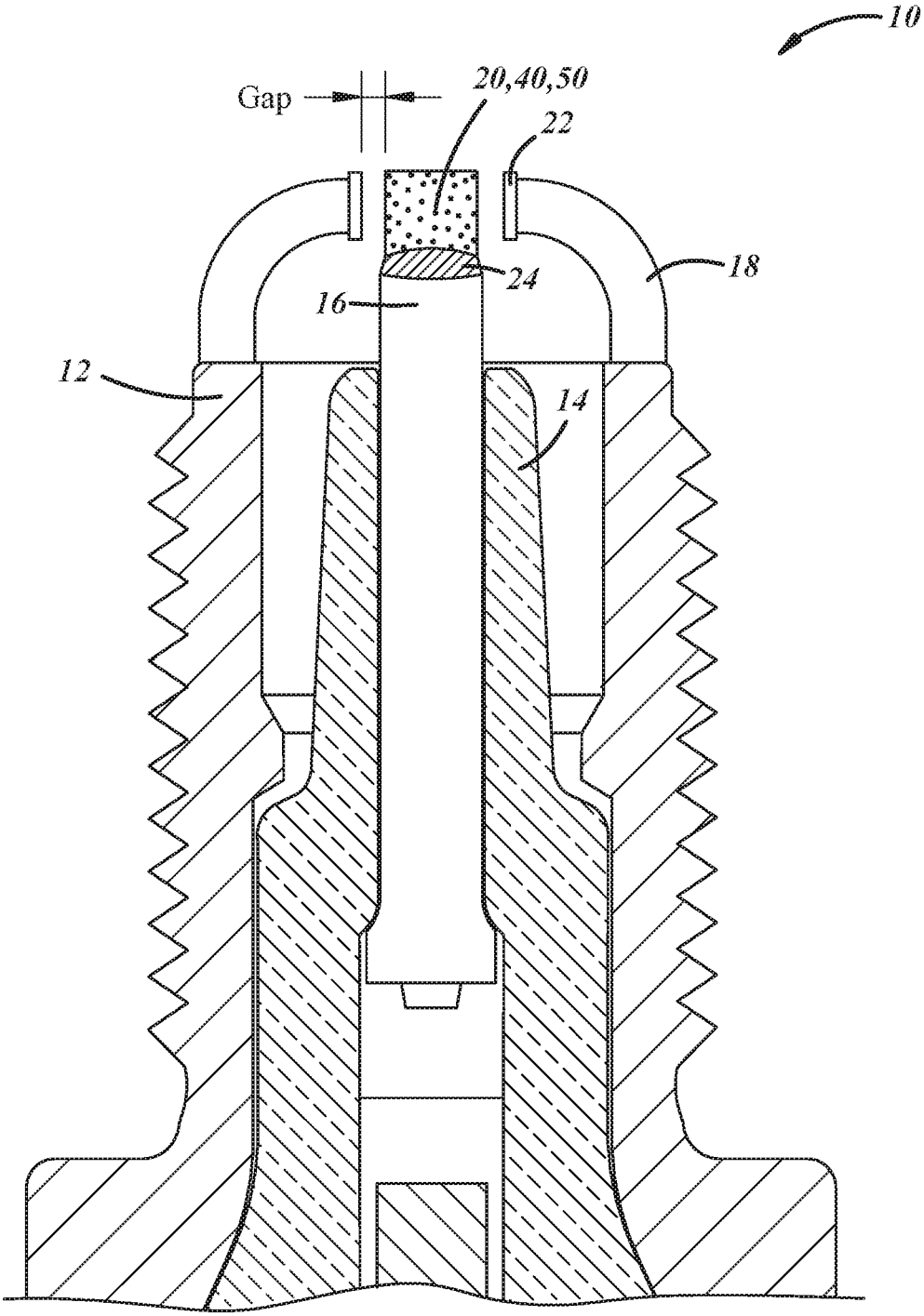
FIG. 1 is a partial sectional view of a spark plug according to one embodiment.

FIG. 1 shows a spark plug 10 with a metallic sheath or shell 12 surrounding an insulator 14. The insulator surrounds a center electrode 16 which at one end is opposed by an annular ground electrode 18 across a spark gap. The center electrode 16 and ground electrode 18 are ignition electrodes. The center electrode 16 includes an end piece, which in this embodiment is a composite part 20, 40, 50. The ground electrode 18 includes a precious metal ring 22 as an optional end piece which surrounds the composite part. The composite part is attached to the center electrode 16 via a weldment 24 at one end. It should be appreciated that while the following description is primarily directed to the manufacture of a composite part for attachment to a center electrode, the different composite part embodiments described herein may be attached to a ground electrode in addition to or in lieu of their attachment to a center electrode.

In order to produce the composite part 20, 40, 50, it is possible to first manufacture the base-metal green part and transform it into a brown part through debinding. Then it is possible to coat the brown part with the mixture of the powder composed of the precious metal or precious metal alloy and binder, debind the layer thus formed, and sinter the coated brown part. Debinding the base-metal green part before it is coated is more economical than waiting to debind it until after the coating with the precious metal or precious metal alloy, but either process may be used. The layer formed from the precious metal or precious metal alloy can be thin as compared to the thickness or the diameter of the base-metal green part or brown part. Consequently, it does not have to be debound in a separate step before the sintering, but instead—depending on the type of materials used—can also be debound by the sintering process itself.

Figure 2A:
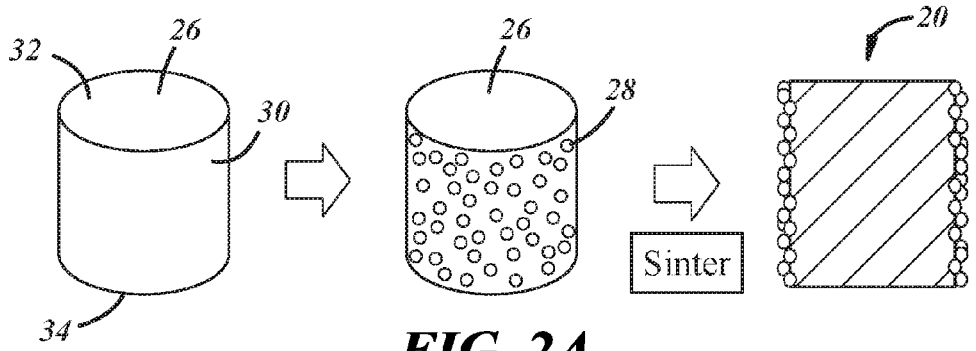
FIGS. 2A-2C illustrate potential manufacturing methods that may be used to manufacture a composite part for a spark plug, such as the spark plug of FIG. 1.

As schematically represented in FIG. 2A, the green part or brown part 26 can be coated with the mixture 28 containing the precious metal or precious metal alloy and binder by the means that it is placed in an injection mold as a core, where the portion of its surface intended for this purpose is covered with the mixture by injection molding. This is especially suitable for the center electrode of spark plugs in which an annular ground electrode surrounds the center electrode, or in which one or more ground electrodes have an end face that faces the lateral surface of the center electrode. In this case, the green part or brown part can be positioned in the injection mold such that only the lateral or circumferential surface 30 of the green part or brown part 26 is covered by injection-molding, yet the two end faces 32, 34 remain free. After sintering, the composite part 20 manufactured in this way can be welded by one end face to the one end of the base-metal section of the ignition electrode 16, while the other end face of the composite part remains free as long as it is not part of the casing, and can remain free because no ground electrode is located opposite it.

An annular ground electrode, as well, can easily be placed in an injection mold as a core in such a manner that only an annular mold cavity remains free, the outer circumferential surface of which is bordered by the inner circumferential surface of the brown part or green part, so that the injected mixture, which contains the precious metal or precious metal alloy as powder and the binder, covers the inner circumferential surface of the brown part or green part and is subsequently adhered thereto by sintering.

In an analogous manner, a ring of ground electrodes that are meant to face the circumferential surface of the center electrode can also be placed in an injection mold as a core such that multiple relatively small mold cavities are formed into which the mixture that contains the precious metal alloy or precious metal as powder and the binder can be injected so that this mixture covers only the radially inward-facing end faces of the ground electrodes forming a ring.

Figure 2B:
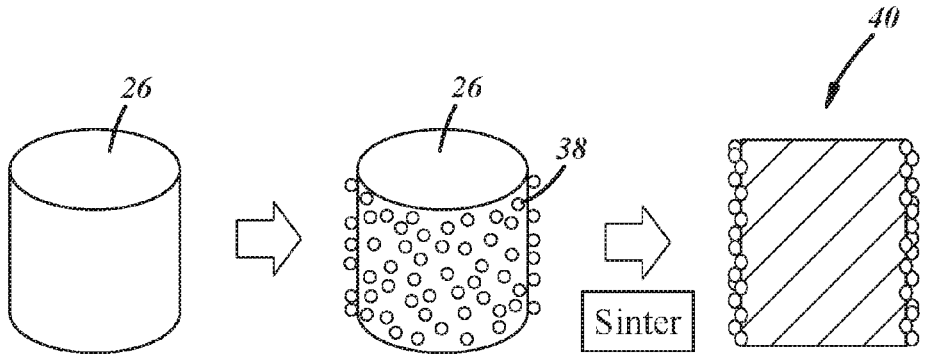

As schematically represented in FIG. 2B, another possibility for coating the green part or brown part 26 with a mixture that contains the precious metal or precious metal alloy and a binder consists in "breading" the green part or brown part on the portion of its surface to be coated, and then sintering it. For this purpose, the powder mixture that contains the precious metal or precious metal alloy has added to it one or more binders which, together with the precious metal powders, form a spreadable paste 38 that ensures the requisite cohesion of the paste applied to the green part or brown part 26 and its adhesion to the green part or brown part until sintering. This formulation consisting of the precious metal powder or powders and binder or binders is also referred to as "panat" here. This approach works especially well for applications that are not well suited to the use of metal injection molding or coextrusion (see the paragraph below). A resulting composite part 40 is formed.

Figure 2C:
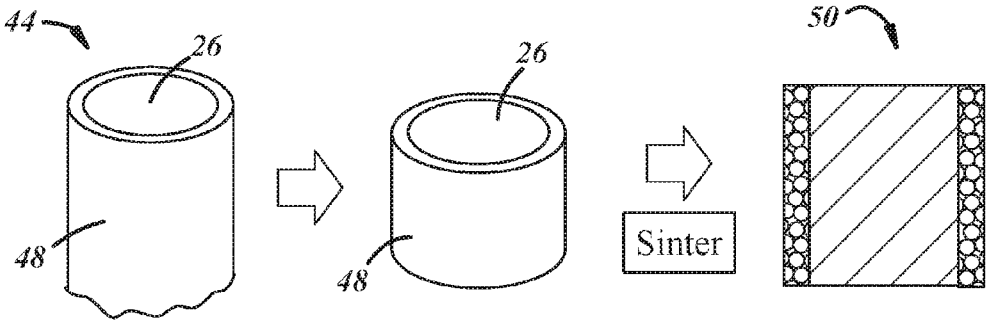

As schematically represented in FIG. 2C, a composite part 50 can be produced using a coextrusion process by the means that a composite strand 44 is formed with the mixture of a powder of the base metal or base metal alloy and a binder together with the mixture of a powder of the precious metal or precious metal alloy and a binder (which can be, but does not have to be, the same binder as the one in the mixture of a powder of the base metal or base metal alloy and a binder), and this composite strand 44 has the base metal or base metal alloy and the binder as its core 26, and has the precious metal or precious metal alloy and the binder as its casing 48. The composite strand 44 is debound, sintered, and then is divided by cross-cutting into a number of composite parts 50 which then can be welded, as already explained further above, to the one end of the base-metal section of the ignition electrode. This method can be modified to the effect that the extruded composite strand is divided into a number of sections even before sintering, which is easier to perform than dividing after sintering. In this version, the debinding can take place before or after the cross-cutting.

Another variant involves producing the composite part by the means that the green part that contains the mixture composed of the base metal or base metal alloy and a binder is printed with the mixture that contains the precious metal or precious metal alloy and a binder, is debound, and then is sintered. This method is especially suitable for tipping an end face of an ignition electrode with precious metal or a precious metal alloy, where the ignition electrode can be a center electrode or a ground electrode or one of four side surfaces of a ground electrode that is rectangular in cross-section. The printing can be performed in automated fashion using a 3D printer or, if the surface to be printed is a flat surface, using a 2D printer.

In a variation of this method, the composite part can be produced in that not the green part, but rather the brown part that contains the base metal powder or the base metal alloy powder, is printed with the mixture composed of the precious metal or precious metal alloy and a binder, and then is sintered. In this case, the binder from the printed layer that contains the precious metal or precious metal alloy, can be debound, for example decomposed and expelled, through the sintering process.

Figure 3:
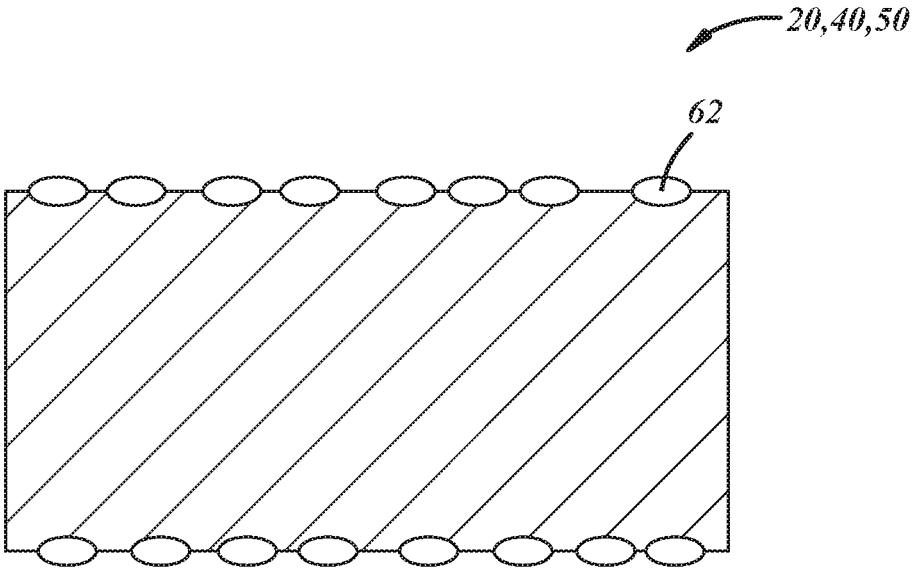
FIG. 3 is a partial view of a composite part for a spark plug, such as the spark plug of FIG. 1.
Figure 4:
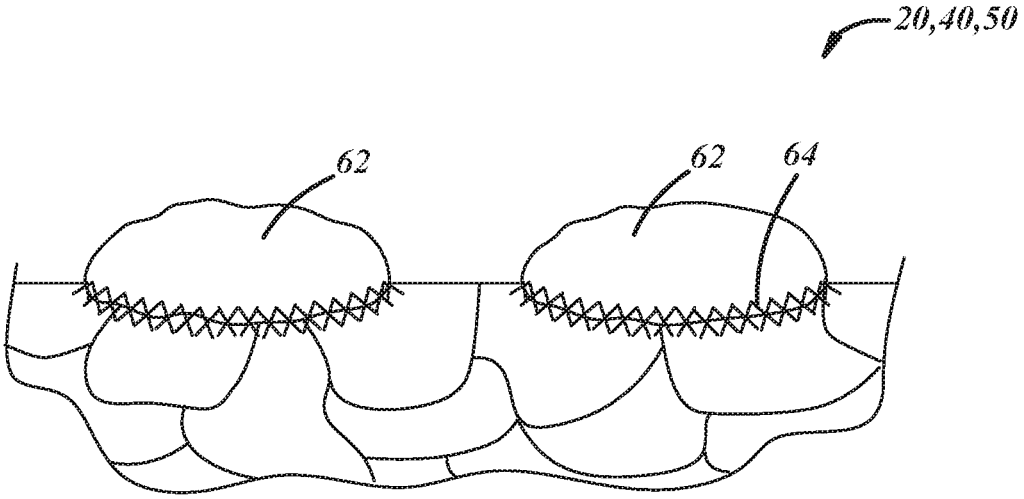
FIG. 4 is an enlarged view of the composite part shown in FIG. 3.

The layer 28, 38, 48 formed that contains the precious metal or precious metal alloy can be thin. It does not necessarily have to cover the entire surface that can be subjected to ignition sparks in the spark plug. On the area bordering the spark gap of the spark plug (see FIGS. 3 and 4), the precious metal or precious metal alloy can form, e.g., islands 62, between which the base metal or base metal alloy comes to the surface. Because of the point effect, in most cases, the ignition sparks will nevertheless start from such a precious metal island and strike the opposing precious metal island on an opposite ignition electrode. In cases in which an ignition spark has a base point between precious metal islands on a region of the base metal and/or strikes the opposite ignition electrode at a point that is composed of the base metal or base metal alloy, this can indeed cause greater erosion there than on the precious metal. However, this ultimately has the result that the islands containing the precious metal or precious metal alloy project that much further above the base formed by the base metal or base metal alloy, thus enhancing the point effect and increasing the probability that the ignition sparks will jump from one precious metal island to another precious metal island. Intermetallic compounds 64 can be formed in the bonding zone that further increase the bonding effect in combination with the interlocking of the layer containing the precious metal or precious metal alloy and the base metal or base metal alloy underneath it.

According to one non-limiting implementation of the present method, a metal injection molding (MIM) process is used to make a nickel-based cylindrical-shaped center electrode core, the center electrode core is debound to form a center electrode core brown part, one of the different embodiments disclosed above is used to apply a mixture having an iridium-based precious metal to a first end of the center electrode core brown part, the center electrode core brown part with the coated first end is sintered so as to produce a cylindrical-shaped composite center electrode piece with a diameter of approximately 0.8 to 3.0 mm and an iridium-based coating with a thickness of approximately 0.2 mm to 0.4 mm, and the composite center electrode piece is welded at an uncoated axial end surface to an uncoated axial end surface of a center electrode. If an embodiment of FIG. 2A or 2B is used to apply a mixture having a binder and an iridium-based precious metal to the first end of the center electrode core brown part, then the center electrode core brown part with the coated first end can be debound before being sintered so that the iridium-based coating shrinks around and onto the center electrode core brown part (which does not shrink to the same degree as a green part), thereby creating a positive mechanical interlock between the components in addition to a metallurgical bond.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. Method for manufacturing an ignition electrode for spark plugs for internal combustion engines that has a section, made of a base metal or base metal alloy, which is tipped at one end with a precious metal or precious metal alloy, characterized by production of a composite part through production by powder metallurgy of a green part or brown part containing the base metal or the base metal alloy;

coating a part of the surface of the green part or brown part with a mixture that contains the precious metal or the precious metal alloy in the form of a powder and a binder;

removal of the binder from the layer formed by coating that contains the precious metal or the precious metal alloy;

sintering of the coated green part or brown part; and welding of the composite part thus formed to the one end of the base-metal section of the ignition electrode, as an end piece.

2. The method according to claim 1, characterized in that a thermoplastic plastic is used as the binder.

3. The method according to claim 1, characterized in that nickel is used as the base metal or a nickel alloy is used as the base metal alloy.

4. The method according to claim 1, characterized in that iridium or platinum is used as the precious metal or an iridium alloy or a platinum alloy or a platinum and iridium alloy is used as the precious metal alloy.

5. The method according to claim 1, characterized in that the composite part is manufactured through metal powder injection molding (MIM).

6. The method according to claim 5, characterized in that, in order to produce the composite part, first the base-metal green part is transformed into the brown part through debinding, in that the brown part is coated with the mixture which contains the powder composed of precious metal or precious metal alloy and binder, and in that the layer thus formed is debound and the coated brown part is sintered.

7. The method according to claim 1, characterized in that the green part or the brown part is coated with the mixture containing the precious metal or precious metal alloy and binder by the means that it is placed in an injection mold as a core, where it is partly covered with the mixture by injection-molding.

8. The method according to claim 1, characterized in that the green part or the brown part is coated with the mixture containing the precious metal or precious metal alloy and binder by the means that it is breaded with the mixture and then is sintered.

9. The method according to claim 1, characterized in that the composite part is produced by forming a composite strand using coextrusion, with the mixture that contains the powder composed of the base metal or base metal alloy and the binder, and with the mixture that contains the powder composed of the precious metal or precious metal alloy and the same or a different binder, and this composite strand has the base metal or the base metal alloy and the binder as its core, and has the precious metal or the precious metal alloy and the same or different binder as its casing; the composite strand being debound, sintered, and divided by cross-cutting into a number of composite parts.

10. The method according to claim 1, characterized in that the composite part is produced by printing the green part or the brown part with the mixture that contains the precious metal or precious metal alloy and the binder, is debound, and then is sintered.

11. A spark plug for internal combustion engines having at least one ignition electrode that is manufactured by the method according to claim 1.

12. A method for manufacturing an ignition electrode for a spark plug for an internal combustion engine, the method comprising the steps of:

producing a core for the ignition electrode by metal injection molding (MIM), the core includes nickel or a nickel alloy and is in the form of a green part when the core is produced;

changing the core from the green part to a brown part by debinding;

applying a mixture to a surface of the core, the mixture includes a binder and a precious metal or a precious metal alloy and the core is in the form of the brown part when the mixture is applied;

removing the binder;

sintering the core with the precious metal or the precious metal alloy to form a composite part, the core is in the form of the brown part when the core is sintered; and attaching the composite part to the ignition electrode; and first forming a green part by metal injection molding (MIM) and then forming a brown part by debinding the green part, the applying step further comprises applying the mixture to a surface of the brown part, and the sintering step further comprises sintering the brown part with the precious metal or the precious metal alloy to form the composite part.

13. The method of claim 12, wherein the applying step further comprises placing the core into a mold and then selectively covering a surface of the core with the mixture by metal injection molding (MIM).

14. The method of claim 12, wherein the applying step further comprises spreading the mixture in the form of a spreadable paste onto a surface of the core.

15. The method of claim 12, wherein the applying step further comprises providing the core to an extruder, providing the mixture to the extruder, and covering a surface of the core with the mixture as a casing by coextruding the core and the mixture together to form a composite strand.

16. The method of claim 12, wherein the applying step further comprises using a 2D or a 3D printer to print the mixture onto a surface of the core.

17. The method of claim 12, wherein the binder of the mixture includes a thermoplastic material and the precious metal or the precious metal alloy of the mixture includes at least one of platinum or iridium.

18. The method of claim 12, wherein the applying step further comprises selectively applying the mixture to a first surface of the core while leaving a second surface of the core free from the mixture.

19. The method of claim 18, wherein the ignition electrode is a cylindrical center electrode, the first surface of the core with the applied mixture corresponds to a lateral surface of the center electrode that is used for sparking, and the second surface of the core without the applied mixture corresponds to an end face of the center electrode that is used to weld the composite part to the center electrode.

20. The method of claim 18, wherein the ignition electrode is an annular ground electrode, the first surface of the core with the applied mixture corresponds to an inner circumferential surface that is used for sparking, and the second surface of the core without the applied mixture corresponds to an outer surface that is used to weld the composite part to the ground electrode.

21. The method of claim 12, wherein the sintering step further comprises sintering the core with the precious metal or the precious metal alloy to form a bonding zone between the core and a plurality of islands having the precious metal or the precious metal alloy.

* * * * *